US007402111B2

(12) United States Patent
Michelau et al.

(10) Patent No.: US 7,402,111 B2
(45) Date of Patent: Jul. 22, 2008

(54) ROCKING HORSE SUSPENSION SYSTEM

(75) Inventors: Frederick Michelau, Des Plaines, IL (US); Thomas Schlegel, Wheaton, IL (US)

(73) Assignee: Radio Flyer Inc., Chicago, IL (US)

( * ) Notice: Subject to any disclaimer, the term of this patent is extended or adjusted under 35 U.S.C. 154(b) by 0 days.

(21) Appl. No.: 11/411,563

(22) Filed: Apr. 26, 2006

(65) Prior Publication Data

US 2007/0010337 A1 Jan. 11, 2007

Related U.S. Application Data

(60) Provisional application No. 60/675,124, filed on Apr. 26, 2005.

(51) Int. Cl.
*A63G 13/08* (2006.01)
*A63G 13/00* (2006.01)

(52) U.S. Cl. ..... 472/103; 472/105; 248/163.2; 248/610; 280/1.191

(58) Field of Classification Search ..... 472/103–105, 472/113, 135, 118; 482/27; 248/593, 610, 248/163, 163.2; 280/1.191; 297/181, 259.4, 297/274

See application file for complete search history.

(56) References Cited

U.S. PATENT DOCUMENTS 1,866,175 A * 7/1932 Rogers, Jr. ..... 248/168
2,437,015 A * 3/1948 Baltz ..... 472/105
2,891,792 A * 6/1959 Thoeming ..... 472/105
2,944,814 A * 7/1960 Thoeming ..... 472/105
2,978,245 A * 4/1961 Rempel ..... 472/105
3,132,860 A * 5/1964 Nantz ..... 472/105
3,155,390 A * 11/1964 Moore et al. ..... 472/99
3,406,934 A * 10/1968 Grudoski ..... 248/593
3,990,667 A * 11/1976 Tomalinas, Jr. ..... 248/370
5,004,216 A * 4/1991 Boudreau ..... 267/179
5,645,489 A * 7/1997 Laiche et al. ..... 472/103
7,172,512 B2 * 2/2007 Be ..... 472/118

* cited by examiner

*Primary Examiner*—Kien T Nguyen
(74) *Attorney, Agent, or Firm*—DLA Piper US LLP; R. Blake Johnston

(57) ABSTRACT

A rocking horse has a stand that includes a base portion with four tubular columns. The columns each have a tubular wall defining an interior. The wall has a top end with a top rim defining a top opening to the interior. An anchor pin extends through the wall and into the interior so that the pin engages two separated locations on the tubular wall. An S-shaped hook has a first end directly attached to the pin within the interior of the tubular wall and a second end extending out of the top opening on each column. The rocking horse also has four resilient members with outer ends connected to the second ends of the hooks, and inner ends connected to the toy horse for suspending the toy horse from the columns.

13 Claims, 3 Drawing Sheets

ROCKING HORSE SUSPENSION SYSTEM

CLAIM OF PRIORITY

This application claims priority from U.S. Provisional Patent Application No. 60/675,124, filed Apr. 26, 2005.

BACKGROUND

The present invention is generally related to children's riding toys, and more particularly, to a suspension system for a rocking horse or other riding toy.

Toy rocking horses typically have a stand with a vertical member at each one of the four corners of the stand. Helical or coil springs typically extend from the tops of the vertical members to a toy horse suspended by the springs in the middle of the stand. With this configuration, when a child is sitting on the horse, the springs permit the horse to be rocked back and forth and bounced up and down.

An example of a typical rocking horse is presented in U.S. Pat. No. 3,155,390 to Moore et al. The Moore et al. '390 patent discloses a rocking or hobby horse featuring a pair of transverse, horizontal rods that pass through and support the toy horse's body. Coil springs are connected between the ends of the horizontal rods and four tubular, generally vertical members positioned one each at the four corners of a stand. Each coil spring has a hook formed on its outer end that passes through a hole formed in the tubular wall of the corresponding vertical member. Significant wear of the hole and coil spring hook may occur with such an arrangement, however, which significantly limits the durability of the product.

U.S. Pat. No. 2,891,792 to Thoeming discloses a rocking horse having a stand that also features tubular, generally vertical members at each corner. A pair of horizontally-aligned holes are formed through the top portion of each vertical member. A ring with two hook-like terminal ends that engage the holes is positioned on the top of each vertical member. Each ring is engaged by a hook formed on the outer end of a corresponding coil spring where the four coil springs cooperate to suspend the horse from the stand. While the arrangement of the Thoeming '792 patent performs well, it is difficult to assemble and also suffers from durability concerns.

A more complex design for a rocking horse is disclosed by U.S. Pat. No. 5,645,489 to Laiche et al. The rocking horse of the Laiche et al. '489 patent features a stand that has a tubular, generally vertical member at each corner. Each tubular member receives a specially designed connector with flanges that engage a projection formed on the interior of the tubular member. An eye-bolt has a stem secured to the connector so that the loop portion of the eye bolt extends out of the end of the tubular member. A coil spring is hooked to the loop portion of the eye-bolt so that the toy horse is cooperatively supported by the springs. Ribbed sleeves fit over the coil springs and upper portions of the tubular members. While the rocking horse of the Laiche et al. '489 patent performs well, the spring connection arrangement is somewhat complicated which leads to increased production costs.

SUMMARY OF THE INVENTION

The present invention is directed to an easily assembled and durable rocking horse suspension system. More specifically, a rocking horse has a toy horse adapted for being sat upon by a child and a stand that includes four columns. Each column has a tubular wall defining an interior. The tubular wall has a top end with a top rim defining a top opening to the interior. An anchor pin extends through the wall and into the interior. The pin engages two separated locations on the tubular wall. An S-shaped hook has a first end attached to the pin within the interior of the tubular wall and a second end extending out of the top opening on each column. The rocking horse also has four resilient members, which are preferably coil springs, with outer ends connected to the second ends of the S-shaped hooks and inner ends connected to the toy horse. As a result, the toy horse is suspended from the columns. Sleeves are positioned over each resilient member and cover a portion of each column.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
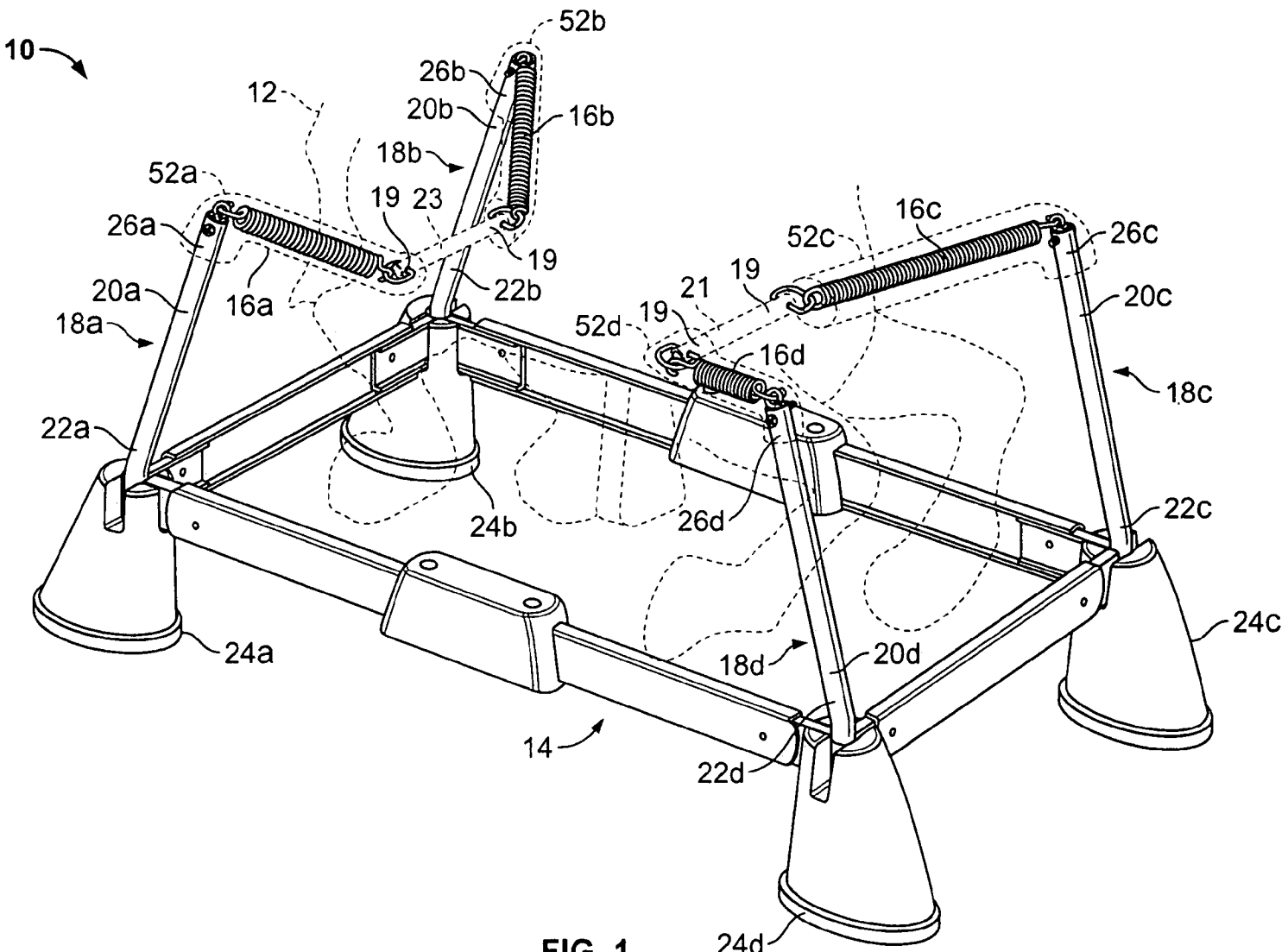
FIG. 1 is a perspective view of a rocking horse constructed in accordance with the present invention.

As shown in FIG. 1, a rocking horse 10 constructed in accordance with the present invention features a toy horse 12 suspended on a stand, indicated in general at 14. More specifically, the toy horse 12 is connected to the stand by four resilient members 16*a-d*, which are preferably coil springs. While a toy horse is described below and illustrated in the figures, it is to be understood that the invention may be used with other types of suspended riding toys.

The stand 14 has four generally vertical members or columns, indicated in general at 18*a-d* in FIG. 1. Each column 18*a-d* features a tubular wall 20*a-d*. Each tubular wall 20*a-d* respectively has a bottom end 22*a-d* connected to feet or base portions 24*a-d* of the stand 14.

Figure 2:
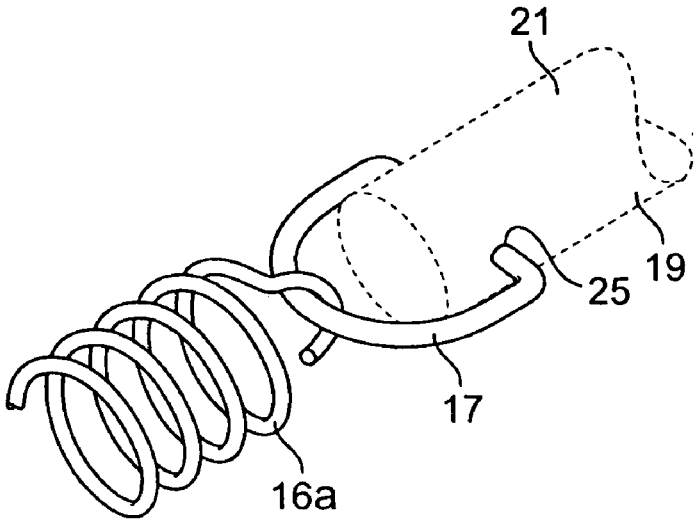
FIG. 2 is an enlarged, perspective view of the connection between the toy horse and the coil spring of the rocking horse of FIG. 1.

As illustrated in FIG. 1, a pair of transverse, horizontal bars 21 and 23 extend through the body of the toy horse and, as described below, support the toy horse on the stand 14. As illustrated in FIG. 2 for resilient member 16a, each resilient member 16*a-d* of FIG. 1 has an inner end connected to a corresponding D-shaped ring 17. In FIG. 2, D-shaped ring 17 is attached to the end portion of bar 19 via a bore 25 that is formed through the bar.

Figure 3:
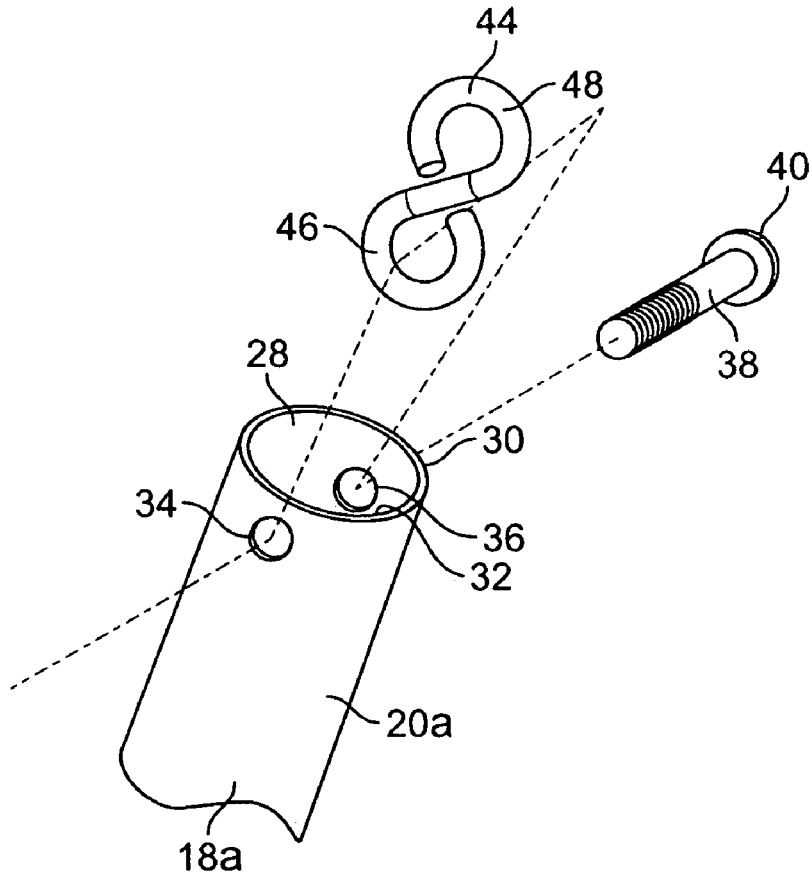
FIG. 3 is an enlarged, exploded view of the top portion of one of the columns and associated hardware of the stand of the rocking horse of FIG. 1.
Figure 4:
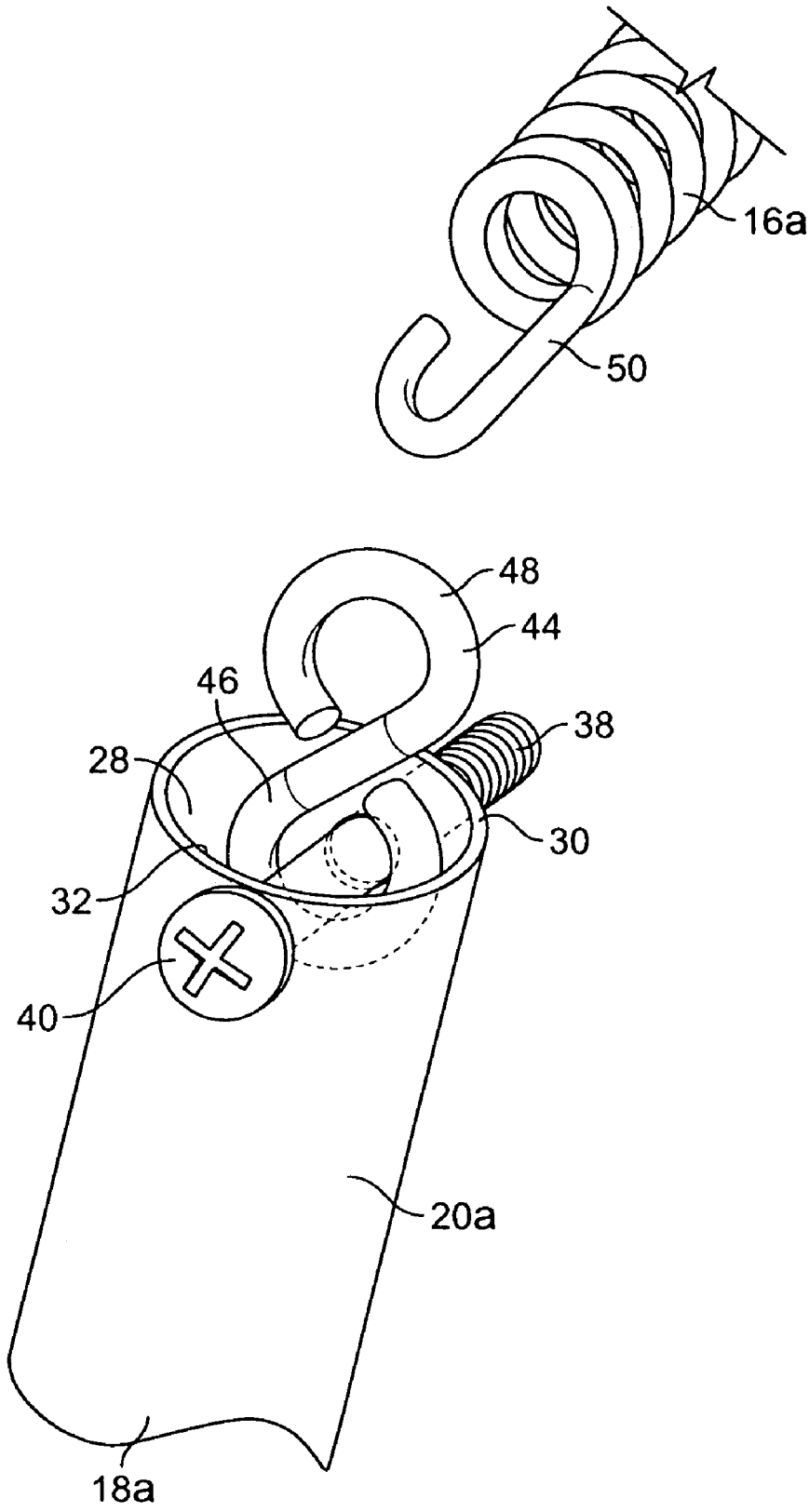
FIG. 4 is an enlarged, partially assembled view of the top portion of the column and associated hardware of FIG. 3 and an outer portion of a corresponding coil spring of the rocking horse of FIG. 1.

As shown in FIG. 1, the outer ends of the resilient members 16*a-d* are connected one each to the top ends 26*a-d* of the columns 18*a*-d. As shown in FIGS. 3 and 4 the tubular wall 20*a* of column 18*a* defines an interior 28. Interior 28 is accessible through a top, main opening 30, which is defined by a top rim 32 on the top end of wall 20*a*. The wall 20*a* features two opposing sidewall holes 34, 36. While only the details of the top of column 18*a* are shown in FIGS. 3 and 4, the remaining columns 18*b-d* are the same.

As illustrated in FIGS. 3 and 4, an anchor pin 38, such as a screw or other fastener, is placed through the sidewall holes 34, 36 so that a head 40 of the pin 38 is disposed on the exterior of one of the sidewall holes. While the illustrated anchor pin 38 is threaded directly to the sidewall holes 34 and/or 36, a nut (not shown) could optionally be used to secure the anchor pin to the wall 20*a*. Alternatively, a pin having no threading at all or a variety of other known fastening devices may be used.

An S-shaped hook 44, as illustrated in FIGS. 3 and 4, has one end 46 secured to the pin 38 within the interior 28 of the wall 20*a*. The other end 48 of the hook 44 extends out of the top opening 30 for attachment to a J-hook 50 (FIG. 4) on the corresponding resilient member 16*a*. As shown in FIG. 4, a substantial portion of the end 48 of hook 44 extends out of the end of wall 20*a*, but it will be appreciated that no limit exists as to how much of hook 44 needs to extend out of column 18*a* and past top rim 32. More specifically, the amount that hook 44 extends of out of the end of wall 20*a* will depend on the angle and design of the top end of column 18*a*. The same may be said, of course, for columns 18*b-d*.

As shown in FIG. 1, sleeves 52*a-d* preferably cover the tops of columns 18*a-d* as well as resilient members 16*a-d*. The sleeves 52*a-d* are made of a plastic, rubber or other flexible material to accommodate the motion of the resilient members without cracking, ripping or breaking.

To assemble the connections at the tops of columns 18*a-d*, the sleeves 52*a-d* are initially positioned over the resilient members 16*a-d* or columns 18*a-d* and slid out of the way. Then, as illustrated in FIGS. 3 and 4 for column 18*a*, the S-shaped hook 44 is held within the tubular wall 20*a* to align the lower portion 46 of the hook 44 with the sidewall holes 34, 36. Next, the anchor pin 38 is placed through one sidewall hole 34 or 36, the lower portion of S-shaped hook 44 and finally through the opposite sidewall hole 36 or 34. The assembler then engages portion 48 of S-shaped hook 44 with the J-hook 50 of the resilient member 16*a* so that it is secured to S-shaped hook 44, and thus column 18*a*. Sleeve 52*a* is then slid over the connection. The procedure is repeated for columns 18*b-d*.

While some of the embodiments of the invention have been shown and described, it will be apparent to those skilled in the art that changes and modifications may be made therein without departing from the spirit of the invention, the scope of which is defined by the appended claims.

What is claimed is:

1. A rocking horse suspension system comprising:

a) a stand including at least one column having a tubular wall defining an interior having a top opening, b) an anchor pin extending through said wall and into said interior;

c) a hook having a first end attached to said pin within said interior of said column between opposing portions of the tubular wall and a second end extending out of said top opening of said column; and d) at least one resilient member having an outer end connected to the second end of said hook and an inner end adapted to be connected to the rocking horse.

2. The rocking horse suspension system of claim 1 wherein said tubular wall has two opposing sidewall holes which are engaged by the anchor pin.

3. The rocking horse suspension system of claim 1 wherein said tubular wall has two opposing, sidewall holes, and Wherein said anchor pin is a screw with a head disposed on an exterior of one of said sidewall holes while threadedly engaging the other said sidewall hole.

4. The rocking horse suspension system of claim 1 wherein said hook is an S-shaped hook.

5. The rocking horse suspension system of claim 1 wherein said stand has four columns respectively attached to four resilient members.

6. The rocking horse suspension system of claim 1 wherein said at least one resilient member is a coil spring.

7. The rocking horse suspension system of claim 1 further comprising a sleeve covering at least a portion of said resilient member and said column of said stand.

8. A rocking horse comprising;

a) a toy horse;

b) a stand including a plurality of tubular columns, each column having an interior and a top end with an opening providing access to said interior;

c) a plurality of S-shaped hooks positioned one each within the interiors of the columns between opposing walls portions of the columns, said S-shaped hooks having ends extending out of the openings of the columns;

d) a plurality of anchor pins one each connecting said S-shaped hooks to said columns; and e) a plurality of resilient members featuring outer ends connected one each to the extending ends of said plurality of hooks and inner ends connected to the toy horse so that the toy horse is suspended from the stand.

9. The rocking horse of claim 8 wherein said tubular columns each have two opposing sidewall holes which are engaged one each by said anchor pins.

10. The rocking horse of claim 8 wherein said tubular columns have two opposing, sidewall holes, and wherein said anchor pins are screws.

11. The rocking horse of claim 8 wherein said stand has four tubular columns attached to four resilient members.

12. The rocking horse of claim 8 wherein said resilient members are coil springs.

13. The rocking horse of claim 8 further comprising a plurality of sleeves positioned one each over said plurality of tubular columns and said plurality of resilient members.

* * * * *